US005678415A

United States Patent [19]

Peckjian et al.

[11] Patent Number: 5,678,415

[45] Date of Patent: Oct. 21, 1997

[54] REFRIGERANT RECOVERY APPARATUS

[75] Inventors: Bryan M. Peckjian, Huntington Valley; Joseph P. Doyle, Malvern; John H. Reilly, Jr., Rosemont, all of Pa.

[73] Assignee: National Refrigeration Products, Bensalem, Pa.

[21] Appl. No.: 588,596

[22] Filed: Jan. 18, 1996

[51] Int. Cl.[6] ..... F25B 45/00

[52] U.S. Cl. ..... 62/149; 62/292

[58] Field of Search ..... 62/77, 85, 149, 62/292, 475

[56] References Cited

U.S. PATENT DOCUMENTS

| | | |
|---|---|---|
| 2,532,452 | 12/1950 | Hoesel . |
| 3,232,070 | 2/1966 | Sparano . |
| 3,425,238 | 2/1969 | Sylvan . |
| 4,170,116 | 10/1979 | Williams . |
| 4,242,878 | 1/1981 | Brinkerhoff . |
| 4,285,206 | 8/1981 | Koser . |
| 4,363,222 | 12/1982 | Cain . |
| 4,412,431 | 11/1983 | Waldrep . |

(List continued on next page.)

OTHER PUBLICATIONS

RIGID SystemSafe brochure entitled "RS-200 Refrigerant Recovery Unit" dated 1993.

OZsaver Light Operations Manual entitled "Recovery & Charging Station".

SRD 1 Operations Manual entitled "Streamline Recovery Device".

National Refrigeration Products catalog dated 1992.

*Primary Examiner*—John M. Sollecito

*Attorney, Agent, or Firm*—Dickstein Shapiro Morin & Oshinsky, LLP

[57] ABSTRACT

A refrigerant recovery apparatus for transferring refrigerant from a first container to a second container includes a compressor having a suction side and a discharge side, a condenser coupled with the discharge side of the compressor and first and second refrigerant inlets and first and second refrigerant outlets. The first and second refrigerant inlets are in fluid communication with the suction side of the compressor. A liquid/vapor switch is suitably positioned between the first refrigerant inlet and the suction side of the compressor to detect whether refrigerant passing through the first refrigerant inlet is in a liquid state or a vapor state. First and second refrigerant outlets are in fluid communication with the discharge and suction sides of the compressor, respectively. The first refrigerant inlet is in fluid communication with the first refrigerant outlet, bypassing the condenser and the compressor. A plurality of valves are controlled automatically by the liquid/vapor switch to transfer liquid refrigerant directly to the second container, bypassing the compressor and condenser, and to pass vaporized refrigerant from the first container through the compressor and condenser and into the second container. A vacuum pump can be provided to evacuate the first container and the apparatus. A sub-cooling mode can also be provided.

14 Claims, 4 Drawing Sheets

U.S. PATENT DOCUMENTS 4,458,497 7/1984 Kubik .
4,476,688 10/1984 Goddard .
4,476,693 10/1984 Johnson .
4,480,446 11/1984 Margulefsky et al. .
4,513,578 4/1985 Proctor et al. .
4,550,573 11/1985 Rannenberg .
4,566,291 1/1986 Halavais .
4,584,838 4/1986 AbuJudom, II .
4,688,388 8/1987 Lower et al. .
4,766,733 8/1988 Scuderi .
4,805,416 2/1989 Manz et al. .
4,809,515 3/1989 Houwink .
4,809,520 3/1989 Manz et al. .
4,856,289 8/1989 Lofland .
4,856,290 8/1989 Rodda .
4,934,390 6/1990 Sapp .
4,938,031 7/1990 Manz et al. .
4,942,741 7/1990 Hancock et al. .
4,969,495 11/1990 Grant .
4,996,848 3/1991 Nelson et al. .
4,998,413 3/1991 Sato et al. .
5,020,331 6/1991 Michny .
5,046,320 9/1991 Loose et al. .
5,095,713 3/1992 Laukhuf et al. .
5,127,239 7/1992 Manz et al. .
5,146,761 9/1992 Cavanaugh et al. .
5,170,632 12/1992 Reilly, Jr. et al. .
5,247,802 9/1993 Maniez et al. .
5,247,804 9/1993 Paige et al. ..... 62/149
5,282,366 2/1994 Reilly, Jr. et al. .
5,363,662 11/1994 Todack ..... 62/149

REFRIGERANT RECOVERY APPARATUS

FIELD OF THE INVENTION

The present invention relates to an apparatus for recovering refrigerant and, more particularly, to an apparatus for recovering refrigerant from a first container and evacuating the container.

BACKGROUND OF THE INVENTION

Commercial and residential refrigeration units, such as refrigerators, air conditioners, heat pumps and other small air-conditioning and refrigeration units use chlorofluorocarbons (CFCs) as a standard heat-transfer media. For many years, when a refrigeration unit needed servicing, it was common practice in the industry to simply release the refrigerant to the atmosphere. That practice is no longer acceptable, nor is it responsible to abandon CFC-containing equipment because it would eventually leak out. It has become increasingly desirable to service CFC-containing units in a manner which prevents the loss of CFCs to the atmosphere or to the environment, and to remove CFCs from non-serviceable units before the refrigerant leaks out.

Several systems have been proposed for evacuating a charged refrigeration system of its refrigerant, and storing it in a receiving container.

One known system provides a portable refrigerant recovery system which consists of an evaporator, a compressor, a condenser and a refrigerant storage container mounted on a two-wheeled hand truck. Liquid refrigerant is evaporated from the evaporator by negative pressure developed by the compressor, compressed by the compressor, reliquified in the condenser, and passed to the storage container.

Another known system for withdrawing and charging refrigerant from or into a refrigeration system passes the withdrawn refrigerant through a vaporizing coil to prevent liquid refrigerant from directly entering a positive displacement transfer pump and to hasten evaporation of the liquid refrigerant. Refrigerant vapor from the pump outlet is liquified in a cooling coil/heat exchanger, which is in communication with a refrigerant storage container. A drawback to this type of system is that while faster than the first process, refrigerant is still evacuated relatively slowly due to the need to vaporize all of the liquid refrigerant being withdrawn from the first container.

Another known refrigerant reclamation and charging unit has a compressor and a condenser and is operated in two different configurations, depending on whether a liquid refrigerant or vaporized refrigerant is being removed. Liquid refrigerant is removed from a disabled refrigeration unit directly to a storage container by forcing vaporized refrigerant from the refrigerant recovery compressor into the disabled refrigeration unit. After all the liquid refrigerant has been removed from the disabled refrigeration unit, the hoses are re-configured such that the compressor pulls a vacuum on the disabled refrigeration unit to remove the vaporized refrigerant. This system provides the advantage of removing liquid refrigerant at a high rate, however, additional time is required to reconfigure the hoses to recover vaporized refrigerant.

It would be desirable to withdraw both liquid and vaporized refrigerant from a disabled refrigeration unit without requiring the operator to change hoses or readjust the recovery equipment. It would also be desirable to transfer liquid refrigerant directly from a disabled unit to a storage container in a liquid state to achieve a higher refrigerant transfer rate, and then transfer vaporized refrigerant from the disabled unit to the storage container with one equipment set up. It would also be advantageous to be able to evacuate the disabled refrigeration unit with the same equipment after service has been completed.

The present invention is the result of observation of the limitations in the prior known devices, and efforts to solve them.

SUMMARY OF THE INVENTION

Briefly, the present invention provides a refrigerant recovery apparatus for transferring refrigerant from a first container to a second container. The refrigerant recovery apparatus comprises a compressor having a suction side and a discharge side. A first refrigerant inlet, adapted for receiving refrigerant from the first container, is in fluid communication with the suction side of the compressor. A liquid/vapor switch is coupled between the first refrigerant inlet and the suction side of the compressor, with the liquid/vapor switch being located to detect whether refrigerant passing into the apparatus through the first refrigerant inlet is in a liquid state or a vapor state. A first valve, actuatable between an open state and a closed state, is located between the first refrigerant inlet and the compressor. A first refrigerant outlet, adapted for connection to the second container, is provided in fluid communication with the first refrigerant inlet and in fluid communication with the discharge side of the compressor. A condenser having a condenser inlet and a in fluid communication with the discharge side of the condenser outlet is also provided. The condenser inlet is compressor and the condenser outlet is in fluid communication with the first refrigerant outlet. A second valve, actuatable between an open state and a closed state, is located between the condenser outlet and the first refrigerant outlet. A second refrigerant outlet adapted for connection to the first container is provided in fluid communication with the condenser outlet. A third valve, actuatable between an open state and a closed state, is located between the condenser outlet and the second refrigerant outlet. A second refrigerant inlet, adapted for receiving vaporized refrigerant from the second container, is provided in fluid communication with the suction side of the compressor. A fourth valve, actuatable between an open state and a closed state, is located between the second refrigerant inlet and the compressor.

In another aspect, the present invention provides a method for recovering refrigerant from a first container having a liquid port and a vapor port, and storing the refrigerant in a second container. The method comprises the steps of (a) removing refrigerant from the liquid port on the first container;

(b) determining if the refrigerant from the first container is in a liquid state or a vapor state;

(c) passing liquid refrigerant from the first container to the second container;

(d) compressing vaporized refrigerant from the second container to a high pressure, high temperature state;

(e) automatically passing the high temperature, high pressure refrigerant into the vapor port of the first container if the refrigerant was determined to be in the liquid state to force additional liquid refrigerant from the first container into the second container;

(f) automatically passing low temperature, low pressure vaporized refrigerant from the first container to the compressor if the refrigerant was determined to be in a vapor state;

(g) compressing the low temperature, low pressure vaporized refrigerant from the first container to a high pressure, high temperature vaporized refrigerant;

(h) condensing the high temperature, high pressure refrigerant; and (i) passing the condensed refrigerant into the second container.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF PREFERRED EMBODIMENTS

Figure 1:
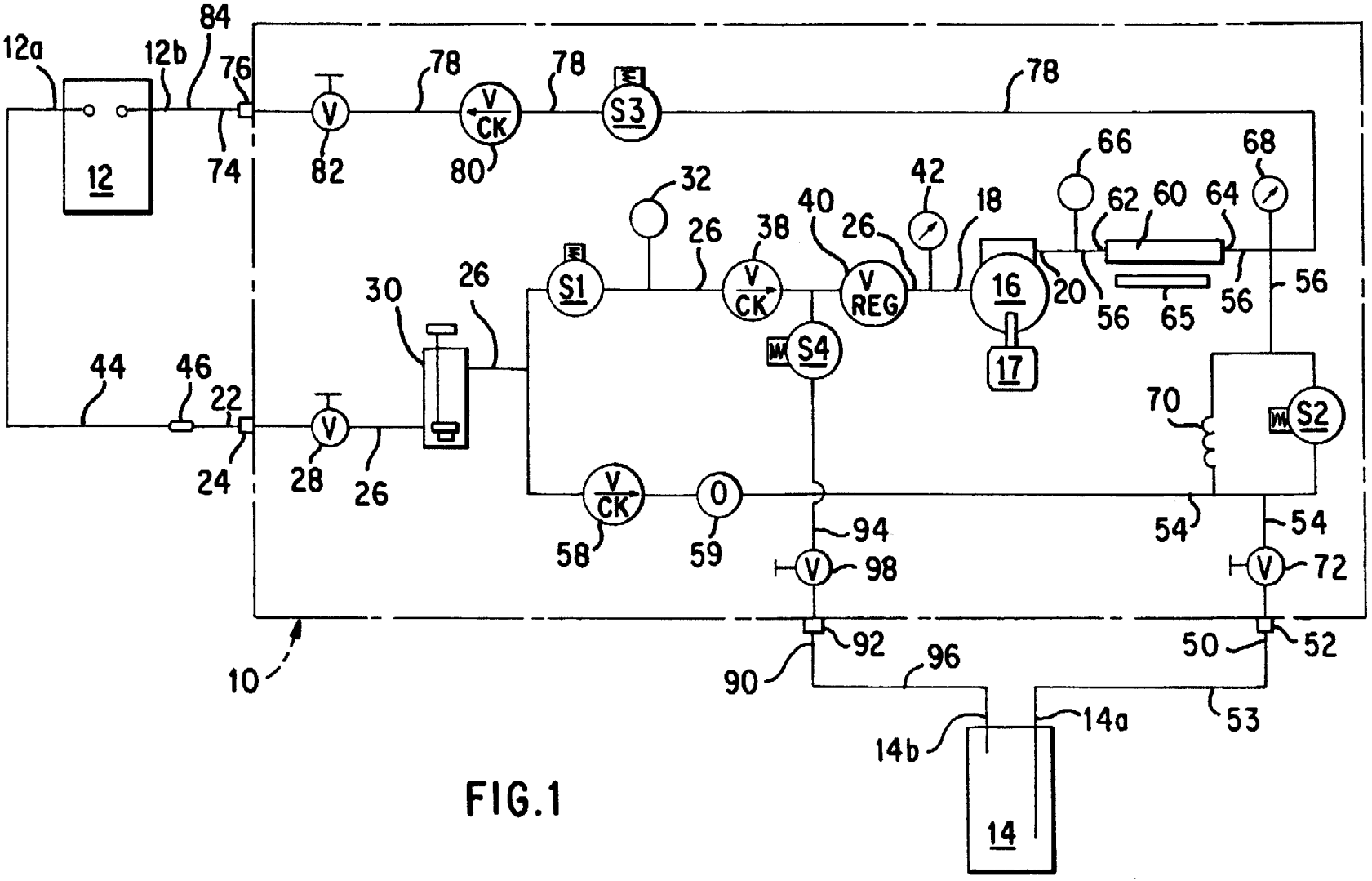
FIG. 1 is a schematic diagram of a refrigerant recovery apparatus in accordance with the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the refrigerant recovery apparatus and designated parts thereof. The terminology includes the words above specifically mentioned, derivatives thereof and words of similar import.

Figure 2:
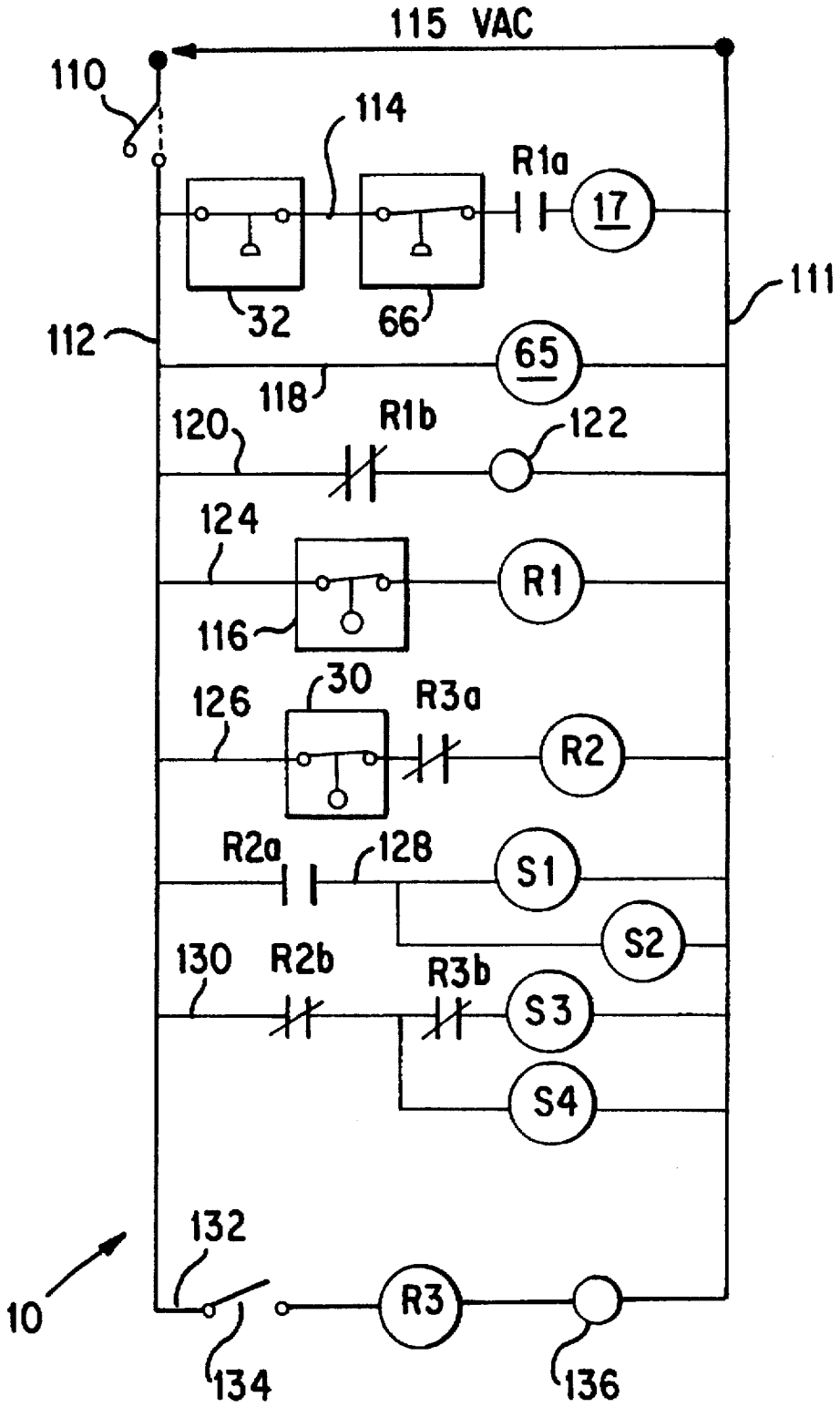
FIG. 2 is a schematic wiring diagram of the refrigerant recovery apparatus.

Referring to the drawings, wherein like numerals indicate like elements throughout, there is shown in FIGS. 1 and 2 a refrigerant recovery apparatus (generally designated 10) in accordance with the present invention.

Referring to FIG. 1, the refrigerant recovery apparatus 10 (encompassed in phantom lines) is indicated schematically and is used for transferring refrigerant from a first container 12 to a second container 14. The first container 12 may be a small appliance, such as a household refrigerator, air-conditioning unit, or heat pump, or any other small air-conditioning and/or refrigeration system well known to those of ordinary skill in the art. The first container 12 has a liquid port **12*a* and a vapor port 12*b* and the second container 14 also includes a liquid port 14*a* and a vapor port 14*b*. The present invention is not limited to use with the specific types of refrigerant containers discussed above, and may also be used to recover refrigerant from automotive air conditioners, for example, as is understood by the ordinarily skilled artisan. The second container 14** is typically a transportable recovery tank in which the recovered refrigerant can be temporarily stored prior to recharging, or stored and removed.

The refrigerant to be transferred is preferably of the high-pressure type, which exists as both a liquid and a gas at room temperature within the pressurized first container 12. Preferably, a refrigerant such as R-12, R-22, R-500, R-502 and R-134*a* may be recovered by use of the present invention. Those of ordinary skill in the art will understand from the present disclosure that a wide variety of refrigerants, too numerous to mention, may also be transferred and recycled with the present invention.

Still with reference to FIG. 1, the refrigerant recovery apparatus 10 includes a compressor 16 having a suction side 18 and a discharge side 20. The compressor 16 is configured to produce a first, relatively lower pressure or partial vacuum at the suction side 18 for drawing refrigerant into the compressor 16. The compressor 16 transfers the refrigerant through the refrigerant recovery apparatus 10 by expelling refrigerant from the discharge side 20 at a second pressure, above atmospheric pressure, and above the pressure of the suction side 18 of the compressor 16. The compressor may be an oiless compressor, or may have an oil port (not shown), and an oil separator (not shown) located on the discharge side 20 of the compressor 16. These types of compressors are known to those of ordinary skill in the art, and accordingly, further description is not believed necessary or limiting.

Preferably, the compressor 16 is driven by a motor 17. The drive shaft of the motor 17 may be connected directly to the compressor 16, or may be connected through a drive train such as a system of pulleys and belt(s) or gears (not shown). The motor 17 is preferably an electric motor which is powered by 115v AC electric current. However, it is understood by those of ordinary skill in the art from the present disclosure that the motor 17 could be pneumatically powered or an engine powered by a fuel such as gasoline could be used.

Still with reference to FIG. 1, a first refrigerant inlet 22 adapted for receiving refrigerant from the first container 12 is provided on the refrigerant recovery apparatus 10. The first refrigerant inlet 22 preferably includes a first hose coupling fitting 24 exposed on the refrigerant recovery apparatus 10. The first refrigerant inlet 22 is in fluid communication with the suction side 18 of the compressor 16 via a first conduit 26.

The first conduit 26, and the other conduits of the refrigerant recovery apparatus 10 described hereinafter, are formed from copper tubing, unless otherwise indicated. However, it is understood by those of ordinary skill in the art from the present disclosure that the first conduit 26 may be made from any other suitable material which is impervious to the refrigerant to be transferred, such as suitable polymeric or metallic materials.

The first hose coupling fitting 24 is connected to the liquid port **12*a* of the first container 12 through a first flexible refrigerant hose 44. Preferably, the first flexible refrigerant hose 44 is a flexible refrigerant hose of the type generally known to those of ordinary skill in the art. A pre-filter 46 is preferably installed in the inlet hose 44. The pre-filter 46 is a particle filter which traps particulate matter in the refrigerant being drawn from the first container 12 to prevent malfunctioning of the components of the refrigerant recovery apparatus 10**. Pre-filter cartridges such as ALCO No. ALF-032, Parker No. PF052-MF, or Sporlan No. C-052 may be used in conjunction with the preferred embodiment. However, it is understood by those of ordinary skill in the art from the present disclosure that other suitable pre-filters can be used, if desired.

A first manual shut-off valve 28 is located along the first conduit 26. Preferably, the first manual shut-off valve 28 is a hand-operated ball valve. However, it is understood by those of ordinary skill in the art from the present disclosure that other types of valves may be used, such as an automatically controlled solenoid valve or gate valve.

A liquid/vapor switch 30 is coupled between the first refrigerant inlet 22 and the suction side 18 of the compressor 16. More particularly, the liquid/vapor switch 30 is located along the first conduit 26 and is located to detect whether refrigerant passing into the apparatus 10 through the first refrigerant inlet 22 is in a liquid state or a vapor state. In the preferred embodiment, the liquid/vapor switch 30 is a float switch. However, it will be appreciated by those of ordinary skill in the art from the present disclosure that a photo-sensor or other suitable type of detector can be used to determine if the refrigerant is in a liquid or a vapor state.

A first valve S1, actuatable between an open state and a closed state, is located between the first refrigerant inlet 22 and the compressor 16. Preferably, the first valve S1 is a solenoid valve and is located in series in the first conduit 26 between the liquid/vapor switch 30 and the compressor 16. Preferably, the first solenoid valve S1 is electrically actuated. However, those of ordinary skill in the art will recognize from the present disclosure that other types of remotely actuated valves, such as mechanically actuated or pressure or vacuum actuated valves, can be used if desired.

A vacuum switch 32 is located along the first, conduit 26 between the liquid/vapor switch 30 and the compressor 16. The vacuum switch 32 detects the vacuum pressure generated by the compressor 16. When the vacuum pressure reaches a predetermined level, preferably approximately 10 inches of Hg, the vacuum switch 32 turns the compressor 16 off, as will be described in more detail below. Preferably, the vacuum switch 32 is of the type generally known to those of ordinary skill in the art. Accordingly, further description is not believed to be necessary or limiting.

A first check valve 38, a pressure regulator 40, and a pressure gauge 42 are preferably located in series along the first conduit 26 between the first solenoid valve S1 and the compressor 16. Preferably, the check valve 38, the pressure regulator 40, and the pressure gauge 42, are of the type generally known to those of ordinary skill in the art, and further description is not believed to be necessary or limiting.

Still with reference to FIG. 1, a first refrigerant outlet 50 adapted for connection to the second container 14 is provided. The first refrigerant outlet 50 includes a second hose coupling fitting 52 exposed on the refrigerant recovery apparatus 10. The first refrigerant outlet 50 is in fluid communication with the first refrigerant inlet 22 through a second conduit 54. More particularly, the second conduit 54 is attached to the first conduit 26 at a position between and in fluid communication with the liquid/vapor switch 30 and the suction side 18 of the compressor 16. The first valve S1 is thus located between, the compressor 16 and the second conduit 54 as well. A check valve 58 and a sight glass 59 are located in series along the second conduit 54. The check valve 58 prevents back-flow of refrigerant toward the liquid/vapor switch 30 and the sight glass 59 allows the operator to observe when liquid refrigerant is being transferred, as explained in more detail below.

The first refrigerant outlet 50 is also in fluid communication with the discharge side 20 of the compressor 16 through a third conduit 56, with the third conduit being connected to the second hose coupling fitting 52 via the second conduit 54.

A condenser 60 having a condenser inlet 62 and a condenser outlet 64 is also provided along the third conduit 56. The condenser inlet 62 is in fluid communication with the discharge side 20 of the compressor 16 and the condenser outlet 64 is in fluid communication with the first refrigerant outlet 50 via the third conduit 56 and the second conduit 54. A condenser fan 65 is located adjacent to the condenser 60 to force cooling air through the condenser 60.

A high-pressure cut-off switch 66 is located along the third conduit 56 between the condenser inlet 62 and the discharge side 20 of the compressor 16. The high-pressure cut-off switch 66 is preferably set at a predetermined pressure, which is approximately 425 psi in the preferred embodiment, and cuts off power to the compressor motor 17 when the pressure on the discharge side 20 of the compressor 16 exceeds the predetermined pressure to protect the equipment and the containers from damage. High-pressure cut-off switches 66 of this type are generally known to those of ordinary skill in the art. Accordingly, further description is not believed to be necessary or limiting.

Preferably, a pressure gauge 68 is located along the third conduit 56 between the condenser outlet 64 and the first refrigerant outlet 50. The pressure gauge 68 is suitable for measuring high pressure and is of the type generally known to those of ordinary skill in the art.

A second valve S2, actuatable between an open state and a closed state, is located along the third conduit 56 between the condenser outlet 64 and the first refrigerant outlet 50. Preferably, the second valve S2 is a solenoid valve similar to the first valve S1, and is located along the third conduit 56.

A capillary tube 70 is located in parallel with the second valve S2 along the third conduit 56 and is connected to the second conduit 54. The capillary tube 70 is in fluid communication between the discharge side 20 of the compressor and the first refrigerant outlet 50. More particularly, the capillary tube 70 is connected between the condenser outlet 64 and the first refrigerant outlet 50. The capillary tube 70 is of the type known to those of ordinary skill in the art from the present disclosure, and in a preferred embodiment is approximately thirtytwo (32) inches long and has a nominal internal diameter of 0.040 inches. The ordinarily skilled artisan will also understand from the present disclosure that other throttling devices can be used in place of the capillary tube 70, if desired.

A second manual shut-off valve 72 is located along the second conduit 54, adjacent to the first refrigerant outlet 50. The second manual shut-off valve 72 is similar to the first manual shut-off valve 28.

A second flexible refrigerant hose 53, similar to the first flexible refrigerant hose 44 is connected between the second hose coupling fitting 52 and the liquid port **14*a* of the second container 14**.

A second refrigerant outlet 74 is provided on the refrigerant recovery apparatus 10. The second refrigerant outlet 74 is adapted for connection to the first container 12, and more particularly to the vapor port **12*b* of the first container 12, and is in fluid communication with the condenser outlet 64. The second refrigerant outlet 74 includes a third hose coupling fitting 76 exposed on the refrigerant recovery apparatus 10 which is in fluid communication with the condenser outlet 64 via a fourth conduit 78**.

A third valve S3, actuatable between an open state and a closed state, a second check valve 80 and a third manual shut-off valve 82 are located in series along the fourth conduit 78 between the condenser outlet 64 and the second refrigerant outlet 74. Preferably, the third valve S3 is a solenoid valve, similar to the first and second solenoid valves S1 and S2. The second check valve 80 prevents back-flow of refrigerant from the first container 12 through the fourth conduit 78 toward the condenser outlet 64. The second check valve 80 and the third manual shut-off valve 82 are similar to those described above, and accordingly further description is not believed to be necessary.

A third flexible refrigerant hose 84 is preferably used to connect the second refrigerant outlet 74 through the third hose coupling fitting 84 to the vapor port 12*b* of the first container 12. The third flexible refrigerant hose 84 is similar to the first and second flexible refrigerant hoses 44 and 53, as described above.

A second refrigerant inlet 90, adapted for receiving vaporized refrigerant from the second container 14, is exposed on the refrigerant recovery apparatus 10. The second refrigerant inlet 90 is in fluid communication with the suction side 18 of the compressor 16. The second refrigerant inlet 90 includes a fourth hose coupling fitting 92 exposed on the refrigerant recovery apparatus 10 and is in fluid communication with the suction side 18 of the compressor 16 through a fifth conduit 94.

Preferably, a fourth flexible refrigerant hose 96 is connected between the vapor port 14*b* of the second container 14 and the fourth hose coupling fitting 92. The fourth flexible refrigerant hose 96 is similar to the first, second and third flexible refrigerant hoses 44, 53 and 84, described above.

A fourth valve S4, actuatable between an open state and a closed state, is located between the second refrigerant inlet 90 and the compressor 16. More particularly, the fourth valve S4 is a solenoid valve similar to the first, second and third solenoid valves S1, S2, and S3, described above, and is located along the fifth conduit 94 between the suction side 18 of the compressor 16 and the second refrigerant inlet 90. A fourth manual shut-off valve 98 is also located along the fifth conduit 94 adjacent to the second refrigerant inlet 90. The fifth conduit 94 is connected to the first conduit 26 in a position between the first check valve 38 and the pressure regulator 40.

Referring now to FIG. 2, a schematic wiring diagram for the refrigerant recovery apparatus 10 is shown. An ON/OFF switch 110 is connected across a power source which is preferably a 115v AC source, to control power to the refrigerant recovery apparatus 10. When the switch 110 is in the "ON" position (as shown in phantom), power is provided by conductors 111 and 112 to the parallel circuits as described below.

The first circuit element 114, which is electrically connected in parallel between conductors 111 and 112, provides power to the motor 17 for driving the compressor 16. The first circuit element 114 comprises the vacuum switch 32, the high-pressure cut-off switch 66, a first switch R1*a* of a first relay R1, described in detail below, electrically connected in series with the motor 17 for the compressor 16.

The first relay switch R1*a* of the first relay R1 is closed when a tank float switch 116 in the second container 14 indicates that the second container is not full, as described in more detail below. When the second container 14 is full, the first relay switch R1*a* is opened and interrupts the electrical connection to the motor 17 for the compressor 16. The electrical connection through the first circuit 114 is also interrupted when the high-pressure cut-off switch 66 detects a compressor discharge pressure above a predetermined level (preferably 425 psi). The electrical connection through the first circuit element 114 is also interrupted when the vacuum switch 32 detects a pre-determined vacuum level on the suction side of the compressor 16 (preferably 10 inches Hg.)

A second circuit element 118 is electrically connected in parallel between the conductors 111 and 112 to provide power to the condenser cooling fan 65 when the ON/OFF switch 110 is on.

A third circuit element 120 is electrically connected in parallel between the conductors 111 and 112 to provide power to an indicator light 122 which indicates when the second container 14 has been filled. The third circuit element 120 comprises a second relay switch R1*b* of the first relay R1, described in more detail below, connected in series with the indicator light 122. The second relay switch R1*b* of the first relay R1 closes when the second container 14 is full providing power to the indicator light 122.

A fourth circuit element 124 is electrically connected in parallel between the conductors 111 and 112. The fourth circuit element 124 comprises a tank float switch 116 for the second container 14 electrically connected in series with the first relay R1. When the second container 14 is full, the tank float switch 116 opens, interrupting the electrical connection to the relay R1. The first relay R1 then causes the first relay switch R1*a* to open, as described above, to interrupt power to the compressor motor 17, and the second relay switch R1*b* to close, providing power to the indicator light 122.

A fifth circuit element 126 is electrically connected in parallel between the conductors 111 and 112. The fifth circuit element comprises the liquid/vapor switch 30 electrically connected in series with a first relay switch R3*a* of a third relay R3, described in detail below, and the second relay, R2. The first relay switch R3*a* of the third relay is normally closed unless power is provided to the third relay R3, in connection with the subcooling mode described in detail below. When the liquid/vapor switch 30 is open, indicating that liquid refrigerant is being recovered by the refrigerant recovery apparatus 10, no power is provided to the second relay R2. When the liquid/vapor switch 30 is closed, indicating that vaporized refrigerant is being recovered by the refrigerant recovery apparatus 10, power is provided to the second relay R2, which activates the first and second switches R2*a* and R2*b* of the second relay R2, as described below.

A sixth circuit element 128 is electrically connected in parallel between the conductors 111 and 112. The sixth circuit element 128 comprises the first relay switch R2*a* of the second relay R2 electrically connected in series with the first and second solenoid valves S1 and S2, which are electrically connected in parallel. When the liquid/vapor switch 30 is closed, indicating that vaporized refrigerant is being recovered, the second relay R2 is provided with power, and actuates the first relay switch R2*a* of the second relay R2 to close. When the first relay switch R2*a* of the second relay R2 closes, power is provided to open the normally closed first and second solenoid valves S1 and S2. When the liquid/vapor switch 30 is open, indicating that liquid refrigerant is being recovered, the first relay switch R2*a* of the second relay R2 is open, and the first and second solenoid valves S1 and S2 remain closed.

A seventh circuit element 130 is electrically connected in parallel between conductors 111 and 112. The seventh circuit element 130 comprises a second relay switch R2*b* of the second relay R2 electrically connected in series with a second relay switch R3*b* of the third relay R3 and the third solenoid valve S3. The fourth solenoid valve S4 is electrically connected in parallel with the second relay switch R3*b* of the second relay R3 and the third solenoid valve S3. When the liquid/vapor switch 30 is open, indicating that liquid refrigerant is being recovered by the refrigerant recovery apparatus, no power is provided to the second relay R2 in the fifth circuit element, and the second relay switch R2*b* of the second relay R2 remains closed. The second relay switch R3*b* of the third relay R3 is also closed, except during operation in the subcooling mode as described in detail below. Accordingly, when liquid refrigerant is being recovered, power is provided to the third and fourth solenoid valves S3 and S4 to open the normally closed third and fourth solenoid valves S3 and S4. When the liquid/vapor switch 30 is closed, indicating that vaporized refrigerant is being recovered, power is provided to the second relay R2, causing the second relay switch R2*b* of the second relay R2 to open, interrupting power to the third and fourth solenoid valves S3 and S4, causing the third and fourth solenoid valves S3 and S4 to close.

An eighth circuit element 132 is electrically connected in parallel between the conductors 111 and 112. The eighth circuit element 132 comprises a subcool mode ON/OFF switch 134 electrically connected in series with the third relay R3 and a subcool mode timer 136. When the subcool mode is desired, the operator closes the subcool mode ON/OFF switch 134 providing electrical power to the third relay R3. This causes the first and second relay switches R3*a* and R3*b* of the third relay R3 to open, interrupting power to the second relay R2, and consequently the first and second solenoid valves S1 and S2 of the sixth circuit element 128, and the third solenoid valve S3 of the seventh circuit element 130, causing the first, second and third solenoid valves, S1, S2 and S3 to close. The fourth solenoid valve S4 receives electrical power and remains open. After a predetermined time, the timer 136 opens the subcool switch 134.

It is understood by those of ordinary skill in the art that the various components, such as the valves, pressure gauges, sight glasses, pressure and vacuum switches, relays and tank flow switches, are standard items which are readily available, and are interconnected in a manner which is understood by those of ordinary skill in the art. Accordingly, further description is not believed to be necessary, and therefore, is not provided for convenience only, and is not considered to be limiting.

Figure 3:
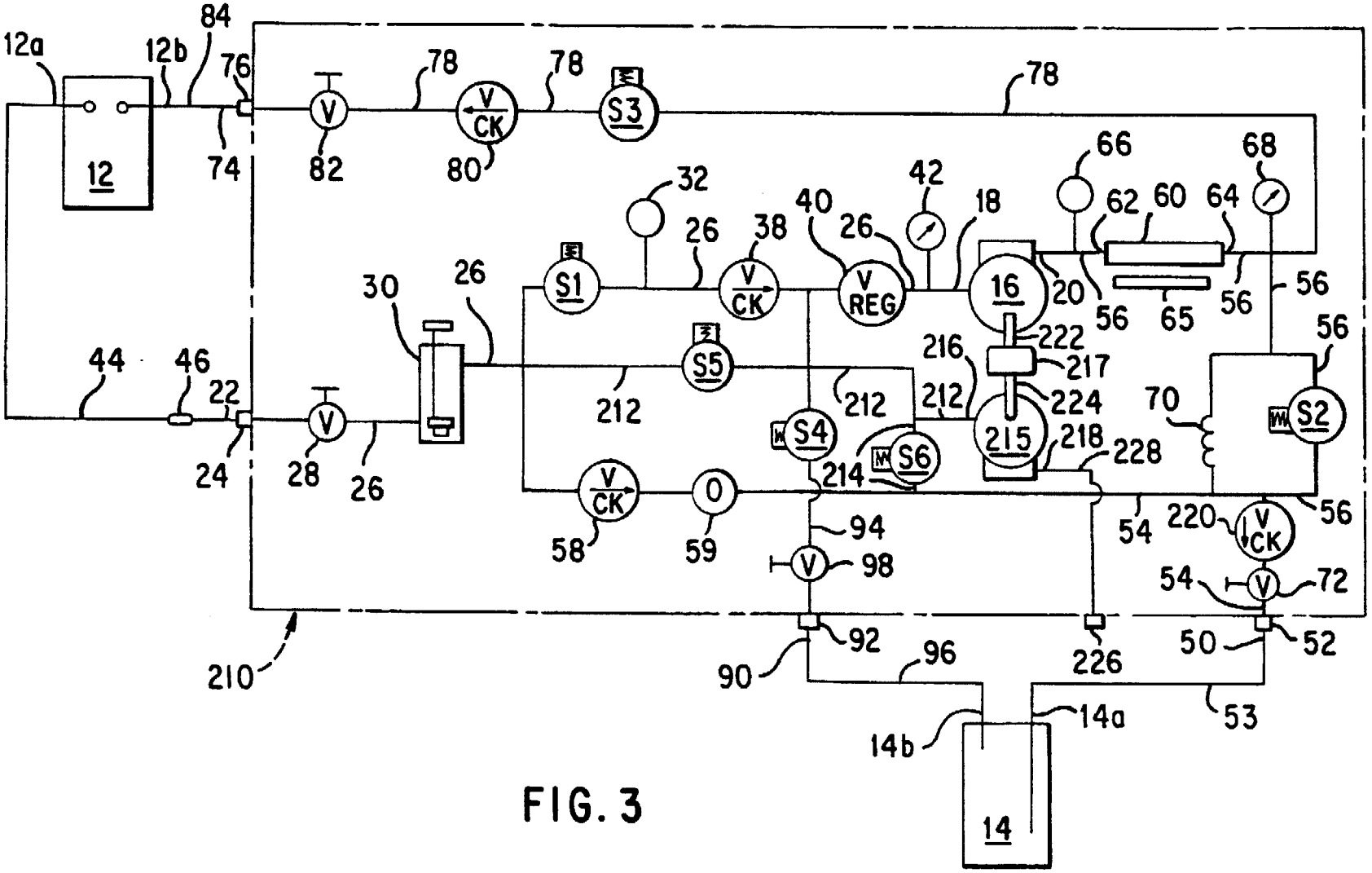
FIG. 3 is a schematic diagram of a second embodiment of a refrigerant recovery apparatus in accordance with the present invention.
Figure 4:
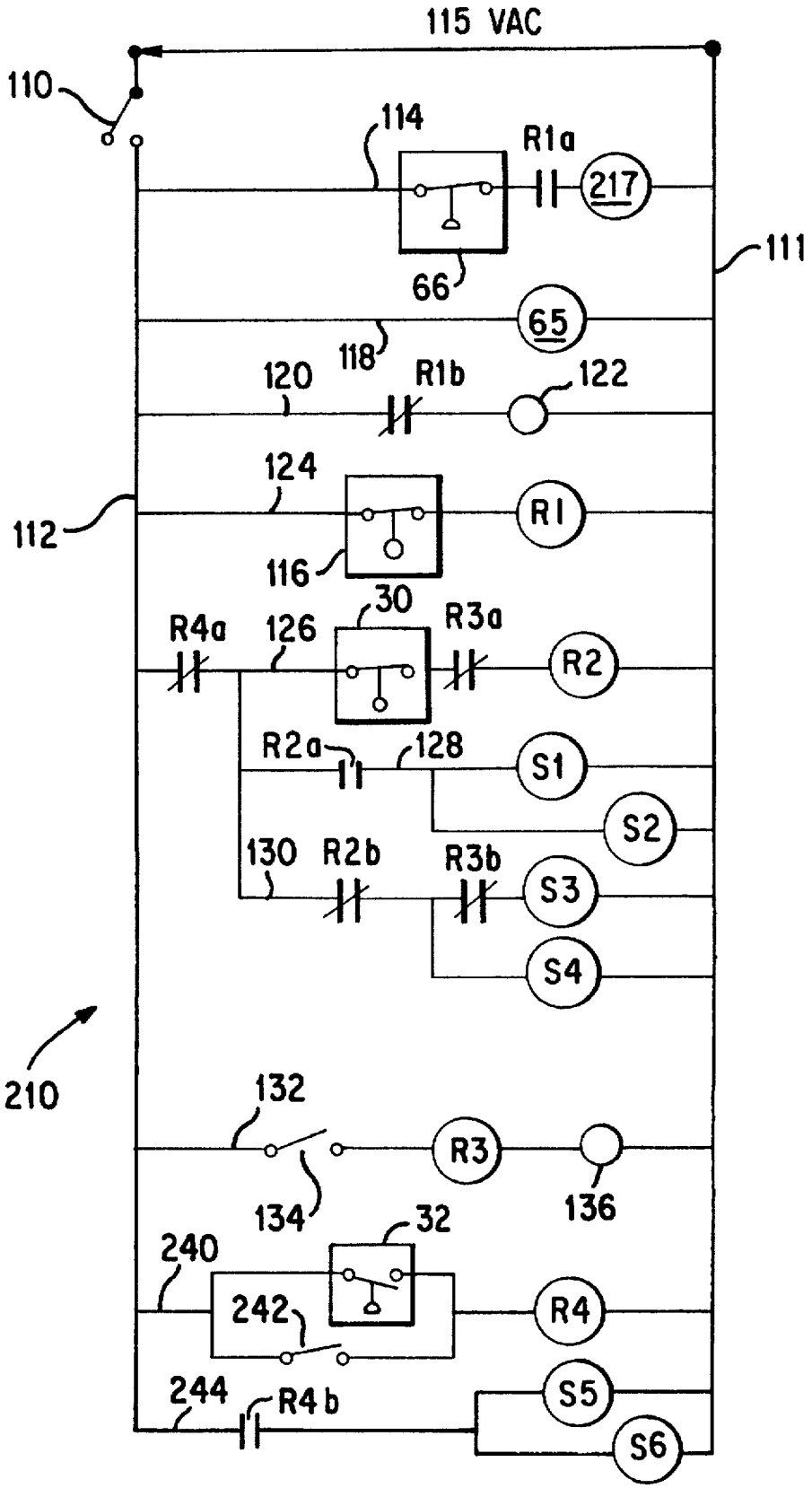
FIG. 4 is a schematic wiring diagram of the second embodiment of the refrigerant recovery apparatus shown in FIG. 3.

A second preferred embodiment of the invention 210 is shown in FIGS. 3 and 4. The second embodiment of the refrigerant recovery apparatus 210 is the similar to the first embodiment and like elements have been designated with like reference numerals throughout. Accordingly, only the differences from the first embodiment of the refrigerant recovery apparatus 10 will be described in detail.

Referring now to FIG. 3, the second embodiment of the refrigerant recovery apparatus 210 includes a vacuum pump 215 having a suction side 216 and a discharge side 218. The suction side 216 of the vacuum pump 215 is in fluid communication with the first refrigerant inlet 22. Preferably, the suction side 216 of the vacuum pump 215 is in fluid communication with the first conduit 26 between the liquid/vapor switch 30 and the first solenoid valve S1 via a sixth conduit 212. The vacuum pump 215 is also in fluid communication with the suction side 18 of the compressor 16 via the fifth conduit 94, which intersects the sixth conduit 212 between the fourth solenoid valve S4 and the intersection with the first conduit 26.

The vacuum pump 215 is preferably a vane pump of the type known to those of ordinary skill in the art. However, any other suitable type of vacuum pump which can draw a vacuum of approximately 20 to 29.92 inches of Hg may be used.

A motor 217 which is drivingly engageable to the vacuum pump 215 and the compressor 16 is provided. The motor 215 has two output shafts 222 and 224, with the first output shaft 222 driving the compressor 16 and the second output shaft 224 driving the vacuum pump 215. It is understood by those of ordinary skill in the art that the motor 215 may be connected with clutches, direct drive couplings, pulleys and belts, reduction gears or other suitable drive systems (none being shown) to the compressor 16 and the vacuum pump 215, and that the type of drive system between the motor 217 and the compressor 16 and the vacuum pump 215 is not critical to the invention. It is similarly understood that the motor 217 may have a single output shaft and both the compressor 16 and the vacuum pump 215 can be driven by the single output shaft.

A fifth valve S5, actuatable between an open state and a closed state, is provided between the suction side 216 of the vacuum pump 215 and the first refrigerant inlet 22. Preferably, the fifth valve S5 is a solenoid valve similar to the first through fourth solenoid valves S1–S4 described above, and is located along the sixth conduit 212.

A sixth valve S6, actuatable between an open state and a closed state, is located between the suction side 216 of the vacuum pump 215 and the second conduit 54. Preferably, the sixth valve S6 is a solenoid valve similar to the first through fifth solenoid valves S1–S5 described above, and is located along a seventh conduit 214, which is in fluid communication between the sixth conduit 212 and the second conduit 54. The sixth and seventh conduits 212, 214 may be coupled through a manifold (not depicted) with the suction side 216 of the vacuum pump 215.

A fourth check valve 220 is located along the second conduit 54, adjacent to the second manual shut-off valve 72, to prevent back flow of refrigerant from the second container 14.

The discharge side 218 of the vacuum pump 215 is in fluid communication with a third refrigerant outlet 226, which is exposed at least to atmosphere on the refrigerant recovery apparatus 210, via an eighth conduit 228.

Referring now to FIG. 4, a schematic wiring diagram for the second embodiment of the refrigerant recovery apparatus 210 is shown. The schematic wiring diagram for the second embodiment 210 is similar to the first embodiment 10, shown in FIG. 2, with the following changes and additions.

As shown in FIG. 4, the vacuum switch 32 has been removed from the first circuit 114, and the motor 217 is connected in place of the compressor motor 17. The fifth, sixth and seventh circuit elements 126, 128 and 130 are isolated by a first relay switch R4*a* for a fourth relay R4, described in more detail below. The first relay switch R4*a* of the fourth relay R4 is generally closed during recycling operations, and is only activated to interrupt power to the fifth, sixth and seventh circuit elements 126, 128 and 130 when the second embodiment of the refrigerant recovery apparatus 210 is in the evacuation mode, described in more detail below.

A ninth circuit element 240 is electrically connected in parallel between the conductors 111 and 112. The ninth circuit element 240 comprises the vacuum switch 32 electrically connected in series with the fourth relay R4. A separate evacuation mode switch 242 is electrically connected in parallel with the vacuum switch 32 and in series with the fourth relay R4.

A tenth circuit element 244 is electrically connected in parallel between the conductors 111 and 112. The tenth circuit element 244 comprises the second relay switch R4*b* of the fourth relay R4 connected in series with the fifth and sixth solenoid valves S5 and S6, which are connected in parallel to each other. The second relay switch R4*b* of the fourth relay R4 is generally open, such that the fifth and sixth solenoid valves S5 and S6 remain closed to isolate the vacuum pump 215.

When the vacuum switch 32 detects a predetermined vacuum pressure at the suction side of the compressor 16, the vacuum switch 32 closes, providing power to the fourth relay R4 which causes the first relay switch R4*a* of the fourth relay R4 to open and a second relay switch R4*b* of the fourth relay R4 to close. The evacuation mode switch 242 can be used to operate the refrigerant recovery apparatus 210 in the evacuation mode by providing power to the fourth relay R4 prior to having a predetermined vacuum pressure at the suction side of the compressor 16.

When power is provided to the fourth relay R4, either by the vacuum switch 32 or the evacuation switch 242, the second relay switch R4*b* of the fourth relay R4 closes, providing power to the fifth and sixth solenoid valves S5 and S6, causing them to open. The first relay switch R4*a* of the fourth relay R4 opens in response to the fourth relay R4 receiving power, cutting off power to the first through fourth solenoid valves S1–S4, causing the first through fourth solenoid valves S1–S4 to close.

The method for recovering refrigerant from the first container 12 and storing the refrigerant in the second container 14 according to the first embodiment 10 of the present invention will now be described generally with reference to FIGS. 1 and 2.

To prepare for refrigerant recovery from the first container 12, the liquid port 12*a* on the first container 12 is connected to the first refrigerant inlet 22 on the refrigerant recovery apparatus 10 with the first flexible refrigerant hose 44. Preferably, the pre-filter 46 is fluidly connected with the hose 44, and the hose 44 is removably connected to the first hose coupling fitting 24 on the refrigerant recovery, apparatus 10. The second flexible refrigerant hose 53 is removably connected between the second hose coupling fitting 52 of the first refrigerant outlet 50 on the refrigerant recovery apparatus 10 and the liquid port 14*a* on the second container 14. The third flexible refrigerant hose 84 is removably connected between the third hose coupling fitting 76 of the second refrigerant outlet 74 on the recovery apparatus 10 and the vapor port 12*b* on the first container 12. The fourth flexible refrigerant hose 96 is removably connected between the fourth hose coupling fitting 92 of the second refrigerant inlet 90 on the recovery apparatus 10, and the vapor port 14*a* on the second container 14. The first, second, third and fourth manual shut-off valves 28, 72, 82 and 98 on the recovery apparatus 10 are opened and the valves (not shown) on the first and second containers 12 and 14 are also opened.

Power is then provided to the refrigerant recovery apparatus 10 and the ON/OFF switch 110 is placed in the ON position to remove refrigerant from the first container 12. Power is provided through the first circuit element 114 for driving the compressor motor 17 to drive the compressor 16. The compressor 16 generates a relatively lower pressure at the suction side 18 to withdraw refrigerant through the liquid port 12*a* of the first container 12. However, if the first container is sufficiently pressurized or if the first conduit 26 has been evacuated, refrigerant will pass automatically from the first container 12 into the first conduit 26. The refrigerant is drawn or otherwise passes into the recovery apparatus 10 through the first refrigerant inlet 22 and through the first conduit 26 to the liquid/vapor switch 30. The liquid/vapor switch 30 determines if the refrigerant from the first container 12 is in a liquid state or a vapor state. If the refrigerant passing from the liquid port 12*b* of the first container 12 is in a liquid state, the liquid/vapor switch 30 changes state and interrupts power through the fifth circuit element 126, causing the second relay R2 to open its first relay switch R2*a* and close its second relay switch R2*b*. In response to the second relay switch R2*b* of the second relay R2 closing, an electrical connection through the seventh circuit element 130 is established and the third and fourth solenoid valves S3 and S4 are opened, and the first relay switch R2*a* of the second relay R2 interrupts the electrical connection through the sixth circuit element 128, causing the first and second solenoid valves S1 and S2 to close. The liquid refrigerant automatically passes from the first conduit 26 to the second conduit 54, through check valve 58 and sight glass 59, bypassing compressor 16 and condenser 60. With the second solenoid valve S2 closed and the capillary tube 70 offering high resistance to fluid flow, the liquid refrigerant passes through the first refrigerant outlet 50 and liquid port 14*a* into the second container 14.

In order to force additional liquid refrigerant from the first container 12 at a high recovery rate, the compressor 16 draws vaporized refrigerant from the vapor port 14*b* of the second container 14 into the recovery apparatus 10 through the second refrigerant inlet 90, the fifth conduit 94 and the fourth solenoid valve S4 toward the compressor suction side or inlet 18. The first check valve 38 prevents back flow of the vaporized refrigerant in the first conduit 26 toward the first container 12. The vaporized refrigerant from the second container 14 is compressed by the compressor 16 to a high temperature, high pressure vaporized state and is passed through the discharge side 20 of the compressor 16 to the condenser 60 via the third conduit 56. The high temperature, high pressure refrigerant is condensed to a high temperature, high pressure liquid refrigerant by the condenser 60, and is passed through the fourth conduit 78, the third solenoid valve S3, the second refrigerant outlet 74 and into the vapor port 12*b* of the first container 12. The high temperature, high pressure refrigerant forces additional liquid refrigerant which is in a lower temperature, lower pressure state in the first container 12 into the recovery apparatus 10 through the first hose 44, the first conduit 26 and the second conduit 54 into the second container 14. Due to the refrigerant being pumped into the first container 12 in a high temperature, high pressure state, liquid refrigerant is pumped into the first container 12 at a rate of approximately 1 lb. per minute, and liquid refrigerant is forced out of the first container 12 at a rate of about 8 lbs. per minute, providing a net rate of about 7 lbs. per minute.

In the event that the liquid/vapor switch 30 detects refrigerant in the vapor state, for example, when the recovery apparatus 10 is unable to force additional liquid refrigerant from the first container 12, the liquid/vapor switch 30 closes and creates and maintains the electrical connection through the fifth circuit element 126, providing electrical power to the second relay R2. The first relay switch R2*a* of the second relay R2 closes, providing power to the first and second solenoid valves S1 and S2, which open. The second relay switch R2*b* of the second relay R2 opens, interrupting power to the third and fourth solenoid valves S3 and S4, which close. In the event of waves or surges of liquid refrigerant entering the apparatus 10, a timer (not shown) prevents repetitive on/off switching of the second relay R2 by providing a 3-second delay before providing power to the second relay R2. With the first solenoid valve S1 open, the low temperature, low pressure vaporized refrigerant from the first container 12 is drawn through the first conduit 26, the check valve 38 and the contaminant accumulator 40 to the compressor 16. The low temperature, low pressure vaporized refrigerant is compressed to a high pressure, high temperature vaporized refrigerant. The high temperature, high pressure vaporized refrigerant is passed from the discharge side 20 of the compressor 16 to the condenser 60 where it is condensed to a high temperature, high pressure liquid refrigerant. The high temperature, high pressure, liquid refrigerant passes through the third conduit 56, the second solenoid valve S2, into the second conduit 54 and through the first refrigerant outlet 50 to the second container 14. Due to the high resistance in the capillary tube 70, little or no refrigerant passes through the capillary tube 70. The check valve 58 prevents the flow of refrigerant through the second conduit 54 and back into the compressor loop.

When the second container 14 reaches 80% capacity, the tank float switch 116 opens, interrupting the electrical connection through the fourth circuit element 124 and the first relay R1. In response, the first relay switch R1*a* of the first relay R1 interrupts power through the first circuit element 114. The second relay switch R1*b* of the first relay R1 closes, providing an electrical connection through the third circuit element 120, which lights the indicator light 122 to indicate that the second container 14 is full. The valves on the second container 14 and the second and fourth shut-off valves 72 and 98 are closed, and the second container 14 is replaced with an empty container in order to continue the removal of refrigerant from the first container 12.

This process continues until almost all of the refrigerant within the first container 12 has been removed. The refrigerant recovery apparatus 10 automatically shuts off when a vacuum pressure of 10 inches Hg is detected by the vacuum switch 32, which opens and interrupts power to the compressor motor 17. The first, second, third and fourth shut-off valves 28, 72, 82 and 98 are then closed, and the refrigerant recovery apparatus 10 can be disconnected from the first and second containers 12 and 14.

If the pressure on the discharge side 20 of the compressor is too high, refrigerant recovery is slowed. Pressure in the second container 14 can be reduced by turning the "subcool mode" on. The subcool mode cools the refrigerant in the second container 14 to reduce the pressure on the discharge side 20 of the compressor 16. The subcool mode is turned on by the subcool mode switch 134 being placed in the ON position. This provides power to the third relay R3, which causes the first relay switch R3*a* of the third relay R3 and the second relay switch R3*b* of the third relay R3 to open. When the first relay switch R3*a* of the third relay R3 opens, power is interrupted to the second relay R2 in the fifth circuit element 126 causing the first and second solenoid valves S1 and S2 to close. The second relay switch R2*b* of the second relay R2 closes, providing power to the seventh circuit element 130. The second relay switch R3*b* of the third relay R3 interrupts power to the third solenoid valve S3, causing the third solenoid valve S3 to close. Power is provided to the fourth solenoid valve S4, causing the fourth solenoid valve S4 to open.

In the subcool mode, vaporized refrigerant is drawn from vapor port **14*b* of the second container 14 through the fifth conduit 94 and the fourth solenoid valve S4 through the contaminant accumulator 40 to the suction side 18 of the compressor 16. The relatively high temperature, high pressure vaporized refrigerant from the second container 14 is compressed to a higher temperature and higher pressure vaporized refrigerant and discharged through the discharge side 20 of the compressor 16. The higher pressure, higher temperature vaporized refrigerant is condensed in the condenser 60 and passes through the third conduit 56 to the capillary tube 70. With the second solenoid valve S2 being closed, the high temperature, high pressure liquid refrigerant is forced at a much reduced rate through the capillary tube 70 where it is throttled to a low temperature, low pressure liquid refrigerant. The low temperature, low pressure refrigerant passes through the first refrigerant outlet 50 into the second container 14. This has the effect of cooling the refrigerant in the second container 14 and lowering the pressure of the refrigerant in the second container 14. After a predetermined period of time (e.g. five (5) minutes), timer 136 returns switch 136** to its open state and the recovery process resumes where it had been interrupted.

In order to clear trapped refrigerant from the refrigerant recovery apparatus 10 after use, the first and third manual shut-off valves 28 and 82 are closed, and an empty container 14 is attached to the recovery apparatus 10. By hitting the subcool mode switch three times in a row, the refrigerant recovery apparatus 10 is effectively self-cleaned. Refrigerant in the system is compressed by the compressor 16, passed through the condenser 60, and forced through the capillary tube 70 to throttle the refrigerant to a low temperature, low pressure state before it is passed through the first refrigerant outlet 50 back to the second container 14. By hitting the subcool mode switch three times, the pressure on the discharge side of the compressor is lowered from approximately 150 psi to 20 psi indicating that very little refrigerant remains in the system.

In order to use the refrigerant recovery apparatus 10 to recover a different type of refrigerant, a separate evacuation with a vacuum pump must be performed to avoid mixing of different types of refrigerant.

Those of ordinary skill in the art will understand from the present disclosure that the pre-filter 46 should be used to avoid malfunctioning of the liquid/vapor switch and solenoid valves through the introduction of particulate contaminants into the refrigerant recovery apparatus 10. Similarly, the refrigerant recovery apparatus 10 is like a refrigeration unit, and must not be open to air. Accordingly, all valves on the refrigerant recovery apparatus 10 must be in the closed position when the refrigerant recovery apparatus 10 is not in use.

The second embodiment of the refrigerant recovery apparatus 210 is operated in a similar manner to the first embodiment 10 to transfer refrigerant from a first container 12 to a second container 14, by detecting the state of the refrigerant being drawn from the first container 12, and passing liquid refrigerant directly to the second container 14, and compressing and condensing vaporized refrigerant from the first container 12 prior to passing it to the second container 14. The subcool mode is also operated in the same manner as described above in conjunction with the first embodiment 10 to subcool the refrigerant in the second container 14.

The second embodiment of the refrigeration recovery apparatus 210 further includes automatic and manual evacuation modes which evacuate the first container 12 and the refrigerant recovery apparatus 210. A brief description of the operation of the evacuation modes of the second embodiment of the refrigerant recovery apparatus 210 follows with reference to FIGS. 3 and 4.

In the second embodiment, the compressor 16 and the vacuum pump 215 are both engaged to the motor 217. When the ON/OFF switch 110 is turned ON, the motor 217 drives both the compressor 16 and the vacuum pump 215. During the initial refrigerant recovery, the vacuum pump 215 is isolated by the fifth and sixth solenoid valves S5 and S6. In the automatic evacuation mode, when both the liquid and vaporized refrigerant have been recovered from the first container 12, as described above in connection with the first embodiment 10, and the vacuum switch 32 detects a vacuum pressure of 10 inches Hg, the vacuum switch 32 closes providing power to the fourth relay R4 of the ninth circuit element 240. The first relay switch R4*a* of the fourth relay R4 opens, interrupting power to the fifth, sixth and seventh circuit elements 126, 128 and 130, causing the first through fourth solenoid valves S1–S4 to close. The second relay switch R4*b* of the fourth relay R4 closes, providing power to the fifth and sixth solenoid valves, S5 and S6, which open. The suction side 216 of the vacuum pump 215 is placed in fluid communication with the first container 12 and the suction side 18 of the compressor 16 via the sixth conduit 212, and in fluid communication with the discharge side 20 of the compressor 16 and the condenser 60 via the seventh conduit 214 and capillary tube 70. The vacuum pump 215 evacuates the first container 12 and the apparatus 210 to 30 inches Hg, and expels the residual refrigerant and contaminants in the first container 12 and the apparatus 210 to the atmosphere through the eighth conduit 228 and the third refrigerant outlet 226. When a vacuum of 30 inches Hg is reached, the ON/OFF switch 110 is manually turned off.

The evacuation mode can also be actuated separately by the evacuation mode switch 242. This is often required prior to recharging for evacuation of a unit which previously had its refrigerant recovered prior to being opened to the atmosphere for repair and then closed, to remove any moisture or contaminants from the unit. This can be done with only the first flexible refrigerant hose 44 connected to the first container 12 and the first manual shut-off valve 28 open, and the second, third and fourth manual shut-off valves 72, 82 and 98 closed.

The evacuation mode switch 242 is turned on providing power to the fourth relay R4, causing the fifth and sixth solenoid valves S5 and S6 to open, and the first through fourth solenoid valves S1–S4 to close, as described above. After the first container 14 and the apparatus 210 have been evacuated to 30 inches Hg, the ON/OFF switch is turned OFF. Although there is a minor efficiency penalty due to operating the compressor 16 and the vacuum pump 215 from the same motor 217, the loss is minimal. The refrigerant recovery apparatus 210 provides the convenience of having recovery and evacuation capabilities with a single recovery unit 210.

It will be appreciated by those of ordinary skill in the art that changes could be made to the embodiment described above without departing from the broad inventive concept thereof. It is understood, therefore, that this invention is not limited to the particular embodiment disclosed, but is intended to cover modifications within the spirit and scope of the present invention as defined by the appended claims.

We claim:

1. A refrigerant recovery apparatus for transferring refrigerant from a first container to a second container, the apparatus comprising:

a compressor having a suction side and a discharge side;

a first refrigerant inlet, adapted for receiving refrigerant from the first container, in fluid communication with the suction side of the compressor through a first conduit;

a liquid/vapor switch coupled between the first refrigerant inlet and the suction side of the compressor, the liquid/vapor switch being located to detect whether refrigerant passing into the apparatus through the first refrigerant inlet is in a liquid state or a vapor state;

a first valve actuatable between an open state and a closed state located between the first refrigerant inlet and the compressor;

a first refrigerant outlet, adapted for connection to the second container, in fluid communication with the first refrigerant inlet through a second conduit attached to the first conduit at a position between the liquid/vapor switch and the suction side of the compressor and in fluid communication with the discharge side of the compressor, said first valve being located along the first conduit between the compressor and the second conduit;

a condenser having a condenser inlet and a condenser outlet, the condenser inlet being in fluid communication with the discharge side of the compressor and the condenser outlet being in fluid communication with the first refrigerant outlet;

a second valve, actuatable between an open state and a closed state, located between the condenser outlet and the first refrigerant outlet;

a second refrigerant outlet, adapted for connection to the first container, in fluid communication with the condenser outlet;

a third valve, actuatable between an open state and a closed state, located between the condenser outlet and the second refrigerant outlet;

a second refrigerant inlet, adapted for receiving vaporized refrigerant from the second container, in fluid communication with the suction side of the compressor; and a fourth valve actuatable between an open state and a closed state, located between the second refrigerant inlet and the compressor.

2. The apparatus of claim 1 wherein the first refrigerant outlet is in fluid communication with the discharge side of the compressor through a third conduit, the condenser and the second valve being located along the third conduit.

3. The apparatus of claim 2 further comprising a capillary tube located in parallel with the second valve along the third conduit, the capillary tube being in fluid communication between the discharge side of the compressor and the first refrigerant outlet.

4. The apparatus of claim 1 wherein the condenser outlet is in fluid communication with the second refrigerant outlet through a fourth conduit, the third valve being located along the fourth conduit.

5. The apparatus of claim 1 wherein the second refrigerant inlet is in fluid communication with the suction side of the compressor through a fifth conduit, the fourth valve being located along the fifth conduit.

6. The apparatus of claim 1 further comprising a vacuum pump having a suction side and a discharge side, the suction side of the vacuum pump being in fluid communication with the first refrigerant inlet;

a motor drivingly engageable to the compressor and the vacuum pump.

7. The apparatus of claim 6 wherein the vacuum pump is in fluid communication with the suction and discharge sides of the compressor.

8. The apparatus of claim 6 further comprising a fifth valve, actuatable between an open state and a closed state, located between the suction side of the vacuum pump and the first refrigerant inlet.

9. The apparatus of claim 1 wherein the first refrigerant inlet includes a first hose coupling fitting exposed on the apparatus, wherein the first refrigerant outlet includes a second hose coupling exposed on the apparatus, wherein the second refrigerant outlet includes a third hose coupling fitting exposed on the apparatus, and wherein the second refrigerant inlet includes a fourth hose coupling fitting exposed on the apparatus.

10. The apparatus of claim 9 further comprising:

a first conduit between the first hose coupling fitting and the suction side of the compressor, the liquid/vapor switch being located along the first conduit;

a second conduit between the first conduit, in a position between the liquid/vapor switch and the compressor, and the first refrigerant outlet, the first valve being located along the first conduit between the second conduit and the compressor;

a third conduit between the discharge side of the compressor and the second hose coupling fitting, the condenser and the third valve being located along the third conduit with the second valve being located between the condenser outlet and the second hose coupling fitting;

a fourth conduit between the condenser outlet and the third hose coupling fitting, the third valve being located along the fourth conduit; and a fifth conduit between the fourth hose coupling fitting and the suction side of the compressor, the fourth valve being located along the fifth conduit.

11. The apparatus of claim 10 further comprising a capillary tube located in parallel with the second valve along the third conduit, the capillary tube being between the discharge side of the compressor and the second hose coupling fitting.

12. The apparatus of claim 11 further comprising:

a vacuum pump having a suction side and a discharge side;

a fifth valve, actuatable between an open state and a closed state, located between the suction side of the vacuum pump and the first refrigerant inlet; and a motor drivingly engageable to the compressor and the vacuum pump.

13. A refrigerant recovery apparatus, comprising:

a first conduit system (26, 54, 94, 78) for transferring liquid refrigerant from a first container (12) to a second container (14) and for simultaneously transferring vaporized refrigerant from said second container to said first container by converting said vaporized refrigerant to a converted liquid refrigerant and transferring said converted liquid refrigerant to said first container;

a second conduit system (26, 56, 54) for transferring vaporized refrigerant from said first container to said second container;

a compressor located within said first and second conduit systems; and a detector and valve system for selectively operating said first and second conduit systems.

14. The apparatus of claim 13 wherein said detector and valve system includes a liquid/vapor switch.

* * * * *